US008555466B1

(12) United States Patent
Wang

(10) Patent No.: US 8,555,466 B1
(45) Date of Patent: Oct. 15, 2013

(54) PANEL CARRYING HANDLE

(75) Inventor: Kuo-Chung Wang, Yunlin County (TW)

(73) Assignee: Hanwit Precision Industries Ltd., New Taipei (TW)

( * ) Notice: Subject to any disclaimer, the term of this patent is extended or adjusted under 35 U.S.C. 154(b) by 40 days.

(21) Appl. No.: 13/447,540

(22) Filed: Apr. 16, 2012

(51) Int. Cl.
*B25G 3/32* (2006.01)

(52) U.S. Cl.
USPC ..... 16/422; 16/DIG. 24; 16/DIG. 41

(58) Field of Classification Search
USPC ..... 16/110.1, 406, 413, 422, 425, 426, 16/DIG. 24, DIG. 25, DIG. 41
See application file for complete search history.

(56) References Cited

U.S. PATENT DOCUMENTS 4,393,540 A * 7/1983 Yamamoto et al. ..... 16/422
5,371,919 A * 12/1994 Winkler ..... 16/422
5,879,100 A * 3/1999 Winkler ..... 403/325
6,415,478 B1 * 7/2002 Watanabe et al. ..... 16/444
6,578,236 B2 * 6/2003 Munari ..... 16/444
6,969,100 B2 * 11/2005 Totani et al. ..... 296/1.02
7,234,888 B2 * 6/2007 Spaulding et al. ..... 403/388

* cited by examiner

*Primary Examiner* — Roberta Delisle

(74) *Attorney, Agent, or Firm* — Muncy, Geissler, Olds & Lowe, PLLC

(57) ABSTRACT

A panel carrying handle includes two mounting barrels respectively affixed to respective first mounting through holes in a border area of a first panel member, two couplings respectively coupled to the mounting barrels and axially movable between a top flange and a bottom flange of the associating mounting barrel, a handle having two brackets located on two downwardly curved distal ends thereof and respectively pivotally connected to the couplings, and two fasteners floatably supported in the couplings and the mounting barrels and fastenable to respective second mounting through holes in a second panel member to detachably lock the first panel member to the second panel member.

7 Claims, 8 Drawing Sheets

PANEL CARRYING HANDLE

BACKGROUND OF THE INVENTION

1. Field of the Invention

The present invention relates to carrying handles and more particularly, to a panel carrying handle pivotally mounted at a first panel member and detachably fastenable to a second panel member by floating fastening means, thereby saving installation space and cost and achieving low-profile.

2. Description of the Related Art

In a machine or industrial computer, tie screws are commonly used to fasten panel members together. When a maintenance work is necessary, an operator can loosen the tie screws and then move the panel members apart. When moving a panel member, for example, circuit board, the operator's hand may touch electronic components of the circuit board accidentally, causing component damage or static impact damage. To avoid this problem, a circuit board may be equipped with a carrying handle. The carrying handle may be fastened to the circuit board by screws. Through the carrying handle, an operator can conveniently carry the circuit board, avoiding component damage. However, it is complicated to affix the carrying handle to the circuit board or to dismount the carrying handle from the circuit board. Further, after removal of the tie screws from the circuit board and a second panel member and dismount of the circuit board from the second panel member, the tie screws may be lost easily if they are not well stored in a storage box. When going to re-install the circuit board in the second panel member, the operator may waste a lot of time in finding the tie screws or new tie screws, complicating the installation or maintenance work. Further, affixing a carrying handle to a circuit board occupies much surface area of the circuit board, i.e., the usable surface area for the mounting of electronic components is relatively reduced.

Therefore, there is a strong demand for panel carrying handle that eliminates the aforesaid problems.

SUMMARY OF THE INVENTION

The present invention has been accomplished under the circumstances in view. It is the main object of the present invention to provide a panel carrying handle, which comprises two mounting barrels respectively affixed to respective first mounting through holes in a border area of a first panel member, two couplings respectively coupled to the mounting barrels and axially movable between a top flange and a bottom flange of the associating mounting barrel, a handle having two brackets located on two downwardly curved distal ends thereof and respectively pivotally connected to the couplings, and two fasteners floatably supported in the couplings and the mounting barrels and fastenable to respective second mounting through holes in a second panel member to detachably lock the first panel member to the second panel member. By means of affixing the mounting barrels to respective first mounting through holes in the first panel member near the border area thereof and coupling the respective couplings to the mounting barrels and then coupling the two brackets of the handle to the couplings, the handle is pivotally connected to the first panel member, and the fasteners are respectively floatably held in the couplings and the mounting barrels for fastening to the second panel member to detachably lock the first panel member to the second panel member without any further hole-drilling or screw-fastening procedure.

Further, each coupling comprises a coupling hole at the center thereof, and two pivot rods respectively extended from the periphery at two opposite sides. Each bracket of the handle comprises two parallel arms and a pivot hole in each arm. By means of affixing the mounting barrels to the first panel member and then coupling the coupling holes of the couplings to the respective mounting barrels and the pivot holes of the brackets of the handle to the pivot rods of the respective couplings, the handle is pivotally connected to the first panel member and can be rested on the first panel member in horizontal, enabling the surface area of the first panel member to be fully utilized for the installation of electronic components or stacking of other panel members.

Further, each coupling comprises an accommodation chamber, and a tapered bearing wall in the accommodation chamber. The coupling hole of each coupling is located in the center of the tapered bearing wall. Further, each mounting barrel comprises an inside partition wall that divides the inside space of the mounting barrel into a top open chamber and a bottom open chamber, and a through hole cut through the inside partition wall. When lifting the handle, the tapered bearing wall of each coupling will be stopped at the bottom side of the cap member of the associating fastener, and the fastener will be moved upwardly with the associating coupling relative to the associating mounting barrel to let an inside stop flange of the cap member of each fastener be stopped at the bottom side of a top flange of the associating mounting barrel or the expanded locking tip of the locking member of each fastener be stopped at the bottom side of a bottom bearing face of the inside partition wall of the associating mounting barrel, and the user can then lift the handle to carry the first panel member to or away from the second panel member.

Further, the fasteners are floatably supported in the respective mounting barrels in such a manner that the inside stop flange of the cap member of each fastener is stoppable below the top flange of the associating mounting barrel and the expanded locking tip of the locking member of each fastener is stoppable below the bottom bearing face of the inside partition wall of the associating mounting barrel, the fasteners will not fall out of the associating mounting barrels at the first panel member after disengagement of the expanded locking tips of the locking members from the second panel member.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
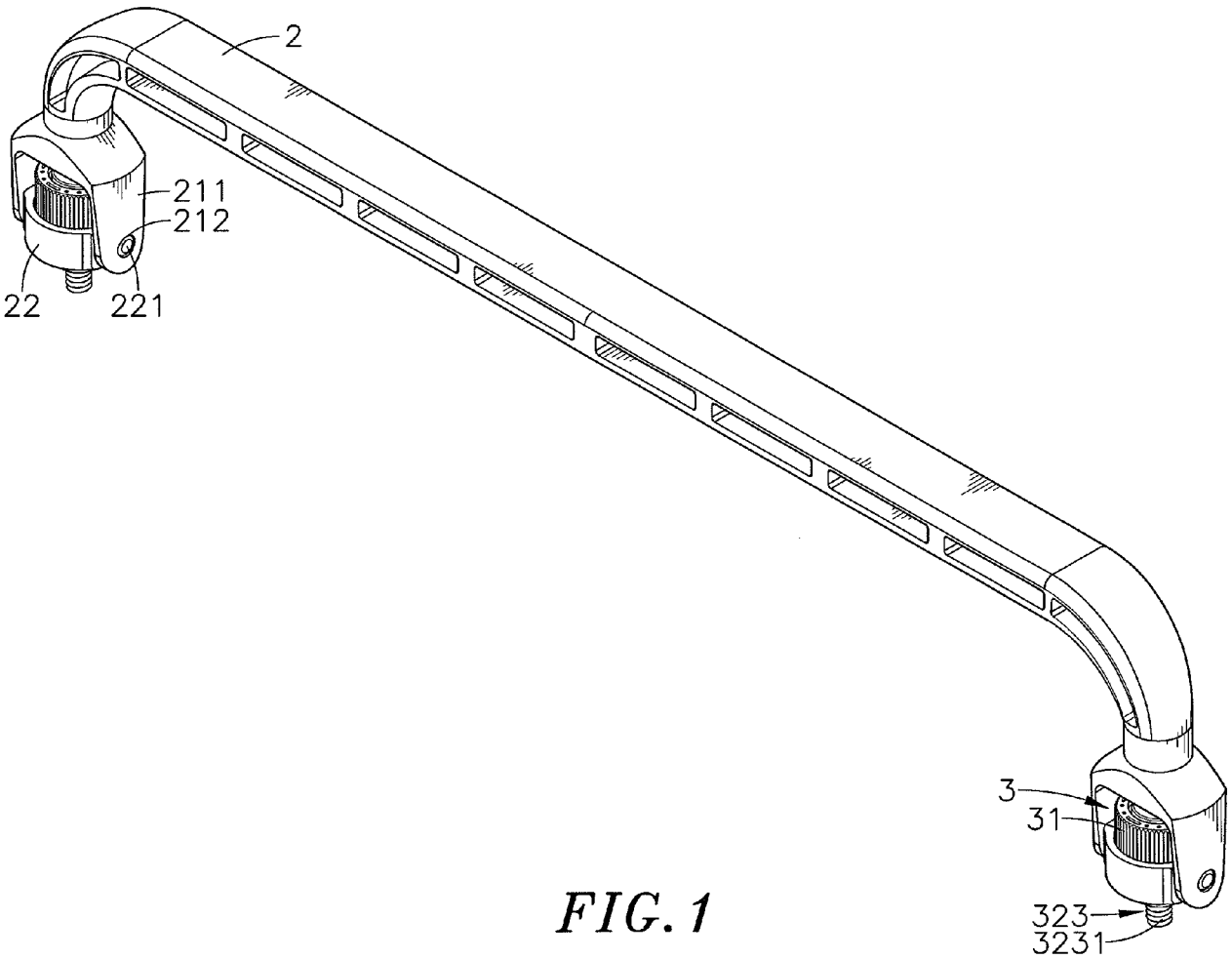
FIG. 1 is an elevational view of a panel carrying handle in accordance with the present invention.
Figure 2:
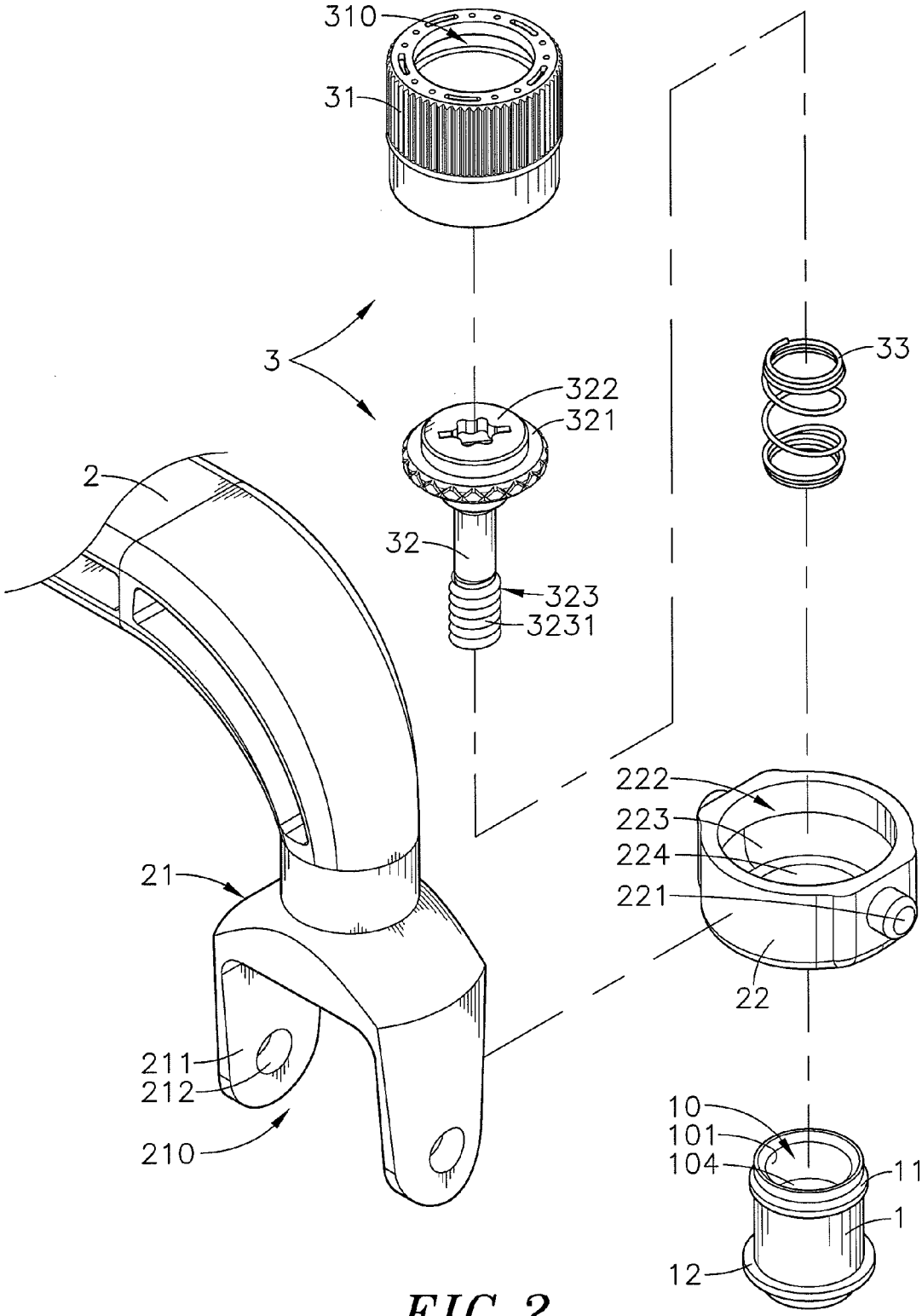
FIG. 2 is an exploded view of a part of the panel carrying handle in accordance with the present invention.
Figure 3:
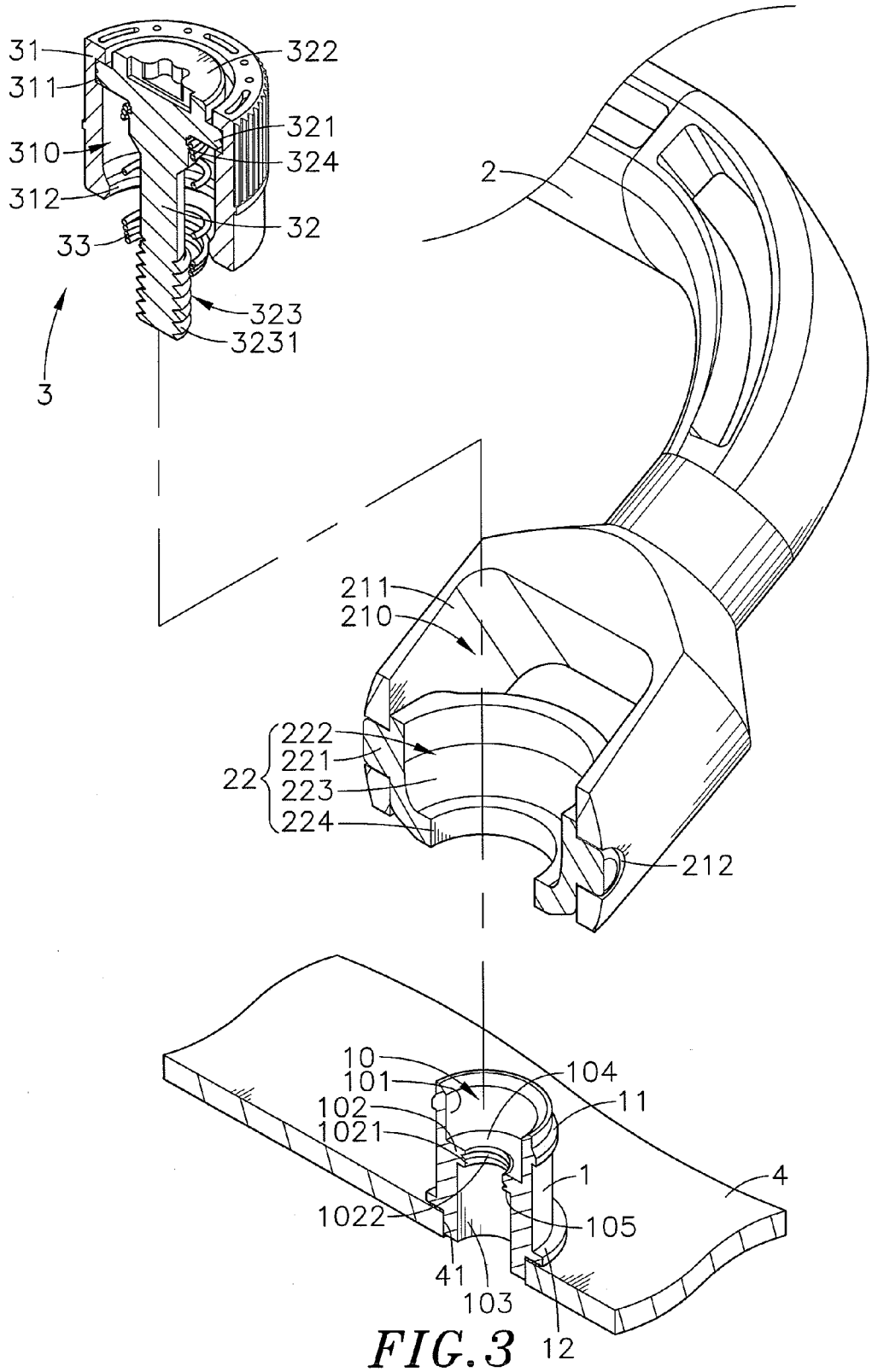
FIG. 3 is a sectional elevation of a part of the panel carrying handle in accordance with the present invention.
Figure 4:
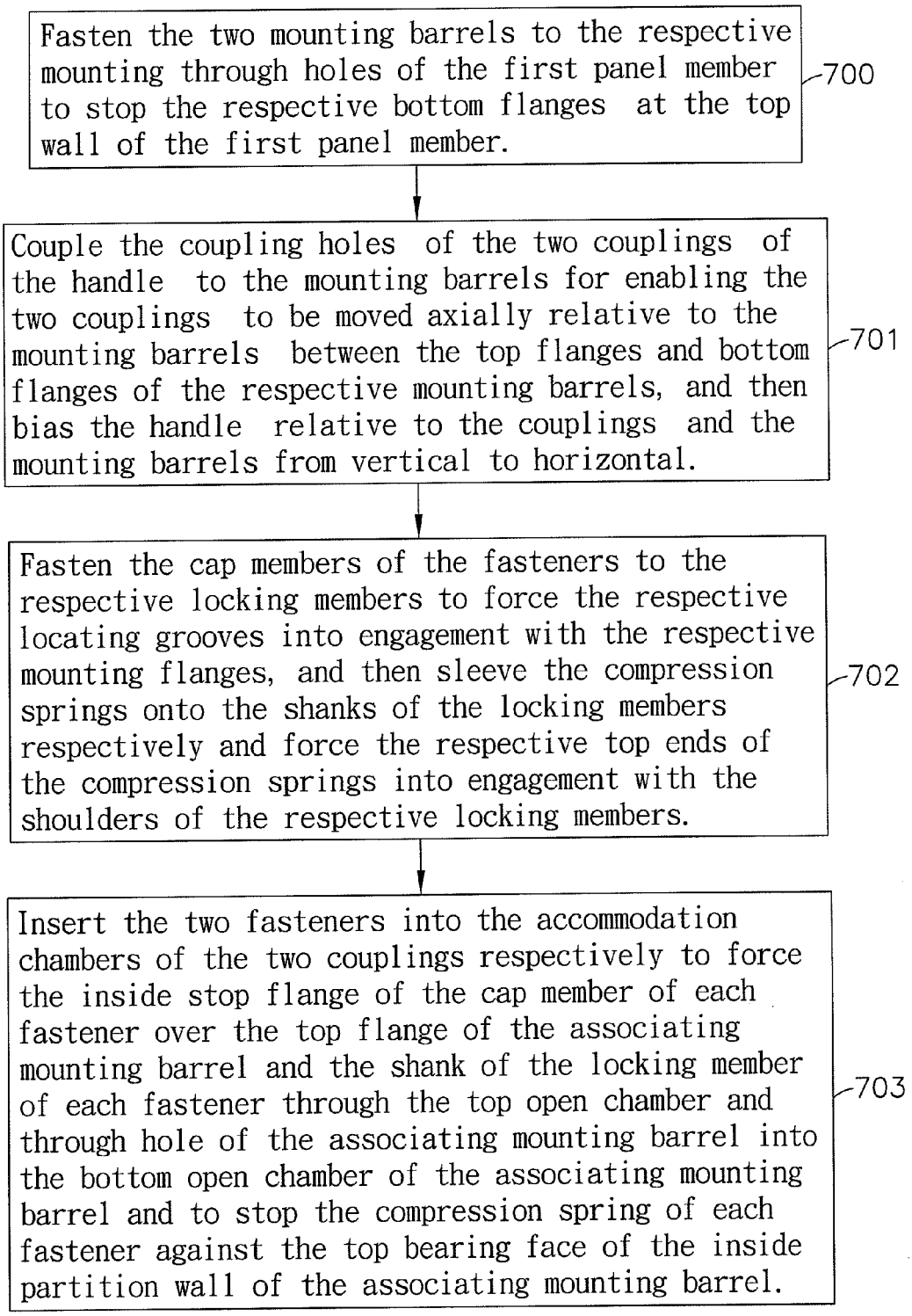
FIG. 4 is a panel carrying handle assembly flow chart in accordance with the present invention.

Referring to FIGS. 1-3 and FIG. 7, a panel carrying handle in accordance with the present invention is shown. The panel carrying handle comprises two mounting barrels 1, a handle 2, and two fasteners 3.

Each mounting barrel 1 comprises an inside partition wall 102 dividing the inside space 10 thereof into opposing top open chamber 101 and bottom open chamber 103, a through hole 1021 located in the center of the inside partition wall 102 in communication between the top open chamber 101 and the bottom open chamber 103, an inner thread 1022 disposed in the through hole 1021, a top flange 11 extending around the periphery near the top end thereof, a bottom flange 12 extending around the periphery and spaced above the bottom end thereof. Further, the inside partition wall 102 defines a top bearing face 104 at the top side thereof and a bottom bearing face 105 at the bottom side thereof. Further, the two mounting barrels 1 are respectively and fixedly mounted in a respective first mounting through hole 41 in a first panel member 4 with the respective bottom flanges 12 stopped against the top wall of the first panel member 4.

The handle 2 is a long rod member, comprising two brackets 21 respectively located on two downwardly curved distal ends thereof. Each bracket 21 comprises two downwardly extending arms 211 defining therebetween an accommodation space 210, two pivot holes 212 respectively and transversely located on the two downwardly extending arms 211, and two couplings 22 respectively coupled between the two brackets 21 of the handle 2 and the mounting barrels 1. Each coupling 22 comprises two pivot rods 221 respectively extended from the periphery thereof at two opposite sides and respectively pivotally coupled to the pivot holes 212 of the associating bracket 21, an accommodation chamber 222 defined therein and facing toward the handle 2, a tapered bearing wall 223 disposed in the accommodation chamber 222, and a coupling hole 224 cut through the center of the tapered bearing wall 223 and coupled to the associating mounting barrel 1.

Figure 5:
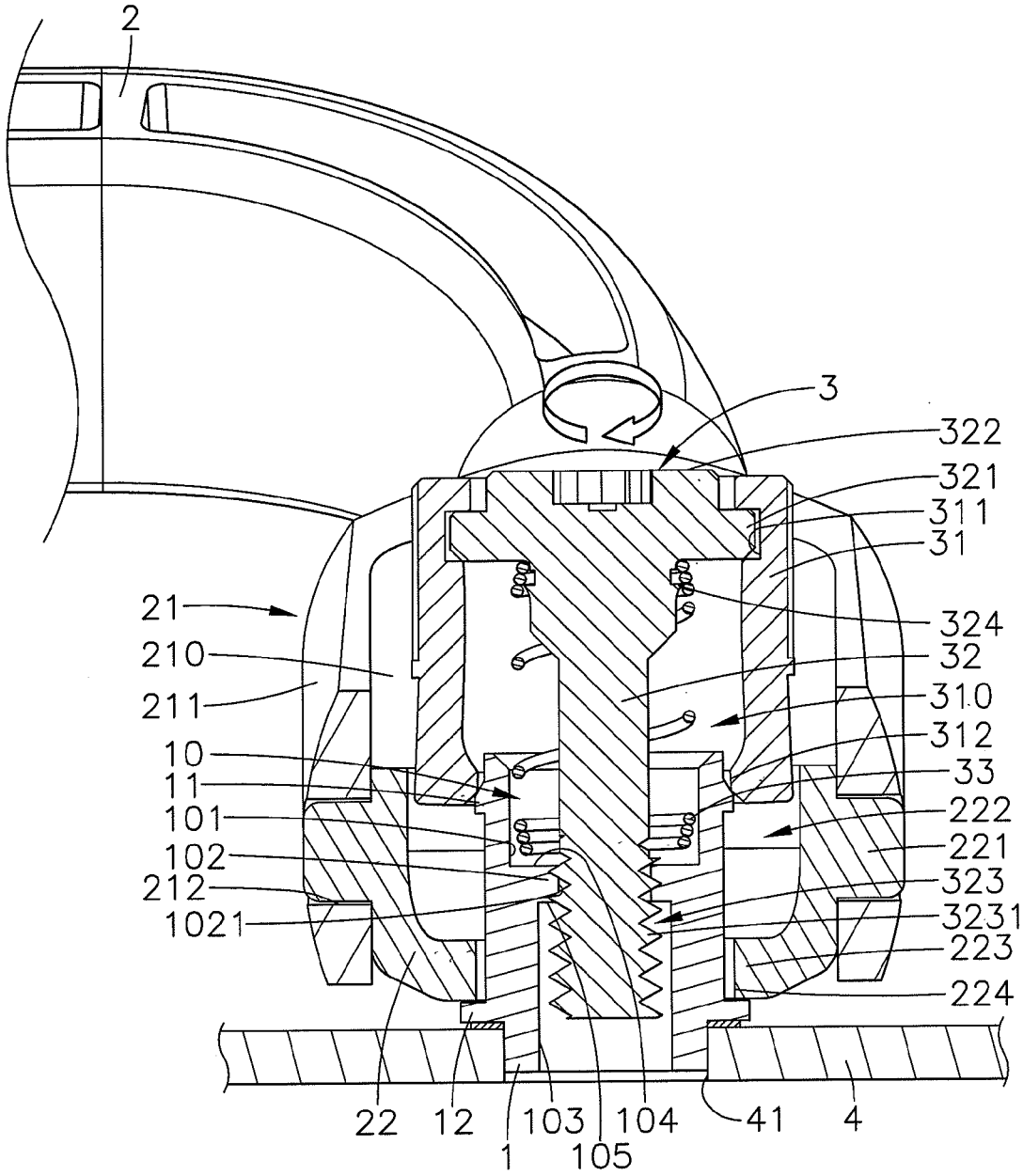
FIG. 5 is a schematic sectional view of the present invention, illustrating the panel carrying handle installed in a first panel member.
Figure 6:
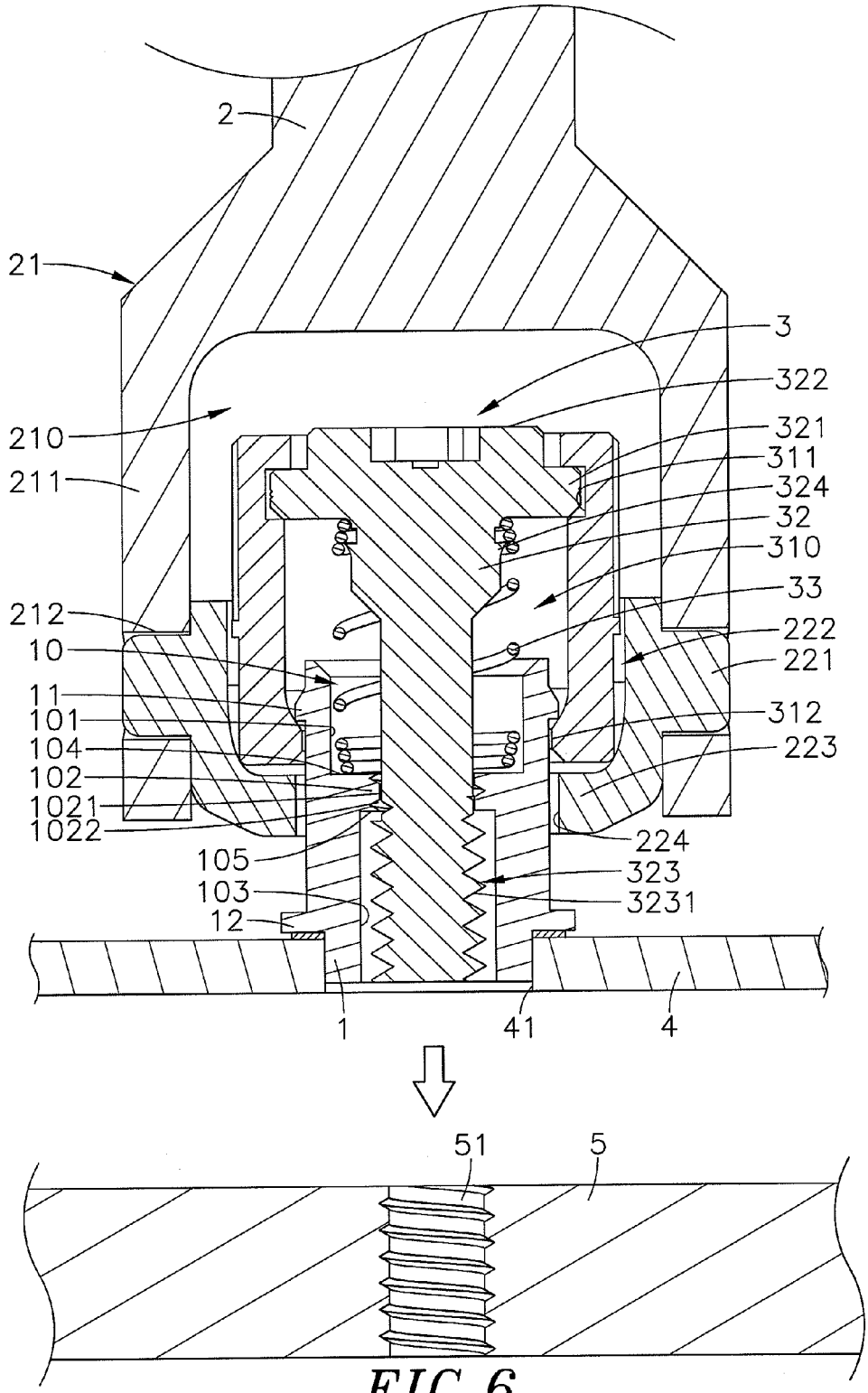
FIG. 6 is another schematic sectional view of the present invention, illustrating the handle lifted during installation.
Figure 7:
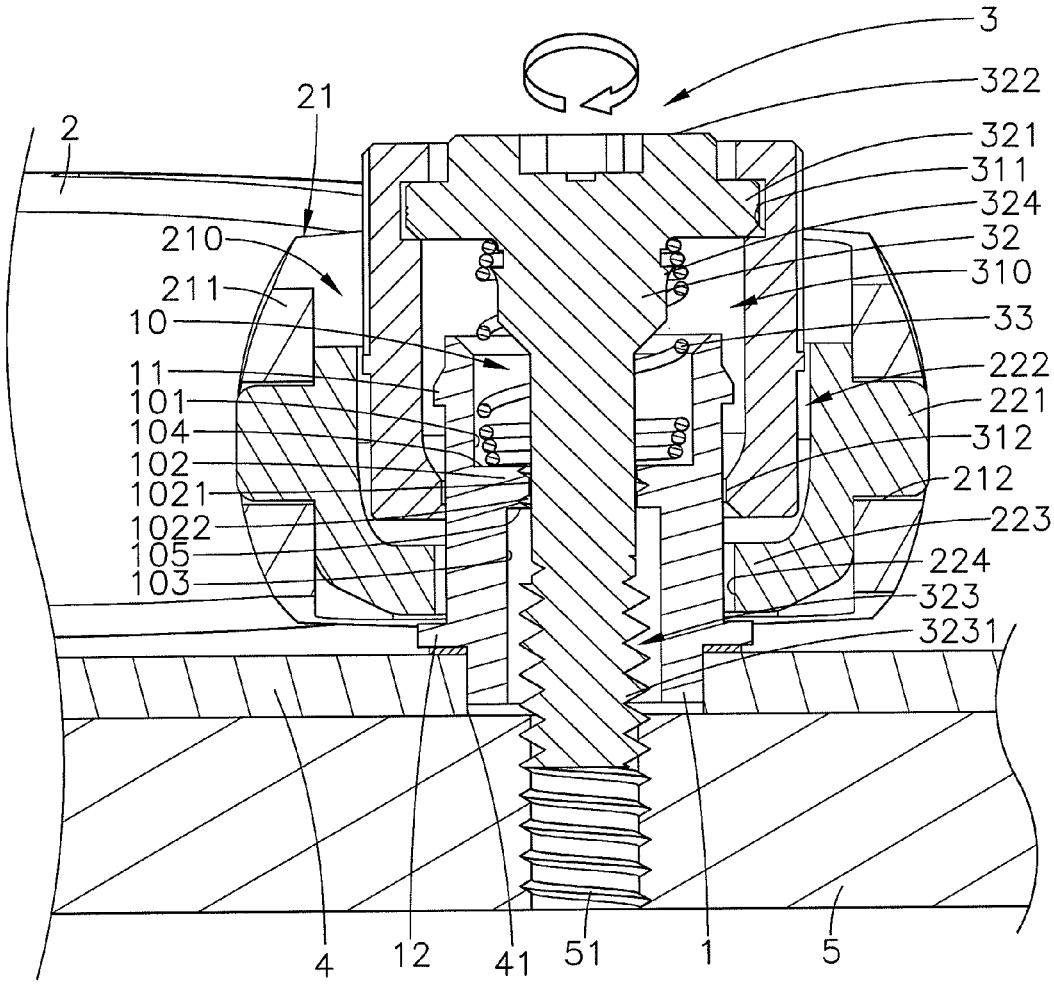
FIG. 7 corresponds to FIG. 6, illustrating the first panel member attached to the second panel member and the locking member threaded into the respective second mounting through hole of the second panel member.
Figure 8:
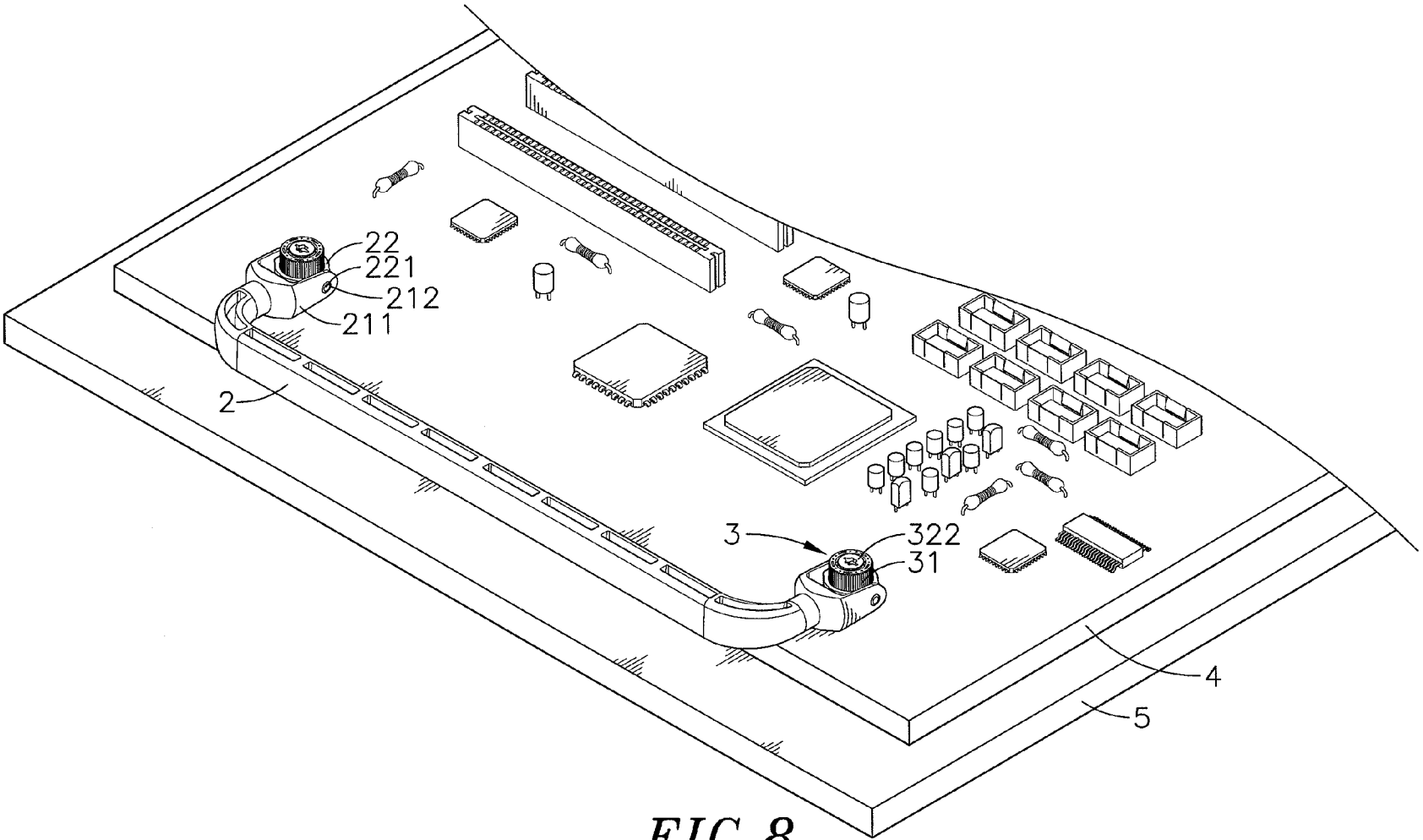
FIG. 8 is an applied view of the present invention.

The two fasteners 3 are respectively mounted in the couplings 22 and the mounting barrels 1 and adapted for locking the first panel member 4 to a second panel member 5 (see also FIGS. 5 and 6). Each fastener 3 comprises a cap member 31, a locking member 32, and an elastic member, for example, compression spring 33. The cap member 31 is inserted into the accommodation chamber 222 of the associating coupling 22 and coupled to the associating mounting barrel 1, having an outer diameter greater than the coupling hole 224 of the couplings 22. The locking member 32 comprises a head 322, a mounting flange 321 extending around the periphery of the head 322, a shank 323 perpendicularly downwardly extended from the bottom wall of the head 321 at the center and terminating in an expanded locking tip 3231 and inserted through the top open chamber 101, through hole 1021 and bottom open chamber 103 of the associating mounting barrel 1 for fastening to a respective second mounting through hole 51 of the second panel member 5, and a shoulder 324 extending around the periphery of the shank 323 and abutted against the bottom wall of the head 322. Further, the cap member 31 comprises a center hole 310 cut through the top wall thereof and press-fitted onto the head 322 of the locking member 32 and stopped at the top side of the mounting flange 321 of the locking member 32, a locating groove 311 extending around the inside wall thereof adjacent to the center hole 310 and forced into tight engagement with the mounting flange 321 of the locking member 32, and an inside stop flange 312 inwardly extended from the bottom edge thereof. The compression spring 33 is sleeved onto the shank 323 of the locking member 32, and stopped between the bottom wall of the head 322 of the locking member 32 and the top bearing face 104 of the inside partition wall 102 of the associating mounting barrel 1. Further, the top end of the compression spring 33 is firmly secured to the shoulder 324 of the locking member 32.

Referring to FIGS. 1-8, the mounting barrels 1, the handle 2, and the fasteners 3 are assembled and installed in the first panel member 4 subject to the following steps:

700 Fasten the two mounting barrels 1 to the respective mounting through holes 41 of the first panel member 4 to stop the respective bottom flanges 12 at the top wall of the first panel member 4.

701 Couple the coupling holes 224 of the two couplings 22 of the handle 2 to the mounting barrels 1 for enabling the two couplings 22 to be moved axially relative to the mounting barrels 1 between the top flanges 11 and bottom flanges 12 of the respective mounting barrels 1, and then bias the handle 2 relative to the couplings 22 and the mounting barrels 1 from vertical to horizontal.

702 Fasten the cap members 31 of the fasteners 3 to the respective locking members 32 to force the respective locating grooves 311 into engagement with the respective mounting flanges 321, and then sleeve the compression springs 33 onto the shanks 323 of the locking members 32 respectively and force the respective top ends of the compression springs 33 into engagement with the shoulders 324 of the respective locking members 32.

703 Insert the two fasteners 3 into the accommodation chambers 222 of the two couplings 22 respectively to force the inside stop flange 312 of the cap member 31 of each fastener 3 over the top flange 11 of the associating mounting barrel 1 and the shank 323 of the locking member 32 of each fastener 3 through the top open chamber 101 and through hole 1021 of the associating mounting barrel 1 into the bottom open chamber 103 of the associating mounting barrel 1 and to stop the compression spring 33 of each fastener 3 against the top bearing face 104 of the inside partition wall 102 of the associating mounting barrel 1.

Further, the mounting barrels 1 can be affixed to the respective first mounting through holes 41 of the first panel member 4 by riveting, press-fitting or reflow soldering. After fixation of the mounting barrels 1 to the respective first mounting through holes 41 of the first panel member 4, the coupling holes 224 of the two couplings 22 of the handle 2 are respectively coupled to the mounting barrels 1, and then the handle 2 is biased relative to the couplings 22 and the mounting barrels 1 from vertical to horizontal to expose the couplings 22 and the mounting barrels 1. Thereafter, the fasteners 3 are respectively inserted into the accommodation chambers 222 of the two couplings 22 to force the inside stop flange 312 of the cap member 31 of each fastener 3 over the top flange 11 of the associating mounting barrel 1, enabling the inside stop flange 312 of the cap member 31 of each fastener 3 to be movable between the top flange 11 of the associating mounting barrel 1 and the tapered bearing wall 223 of the associating coupling 22. At this time, the shank 323 of the locking member 32 of each fastener 3 is inserted through the top open chamber 101 and through hole 1021 of the associating mounting barrel 1 into the bottom open chamber 103 of the associating mounting barrel 1, and the compression springs 33 of the fasteners 3 are respectively stopped between the top bearing faces 104 of the inside partition walls 102 of the respective mounting barrels 1 and the heads 322 of the associating locking members 32. Thus, subject to the spring power of the compression springs 33, the fasteners 3 are movable up and down relative to the respective mounting barrels 1. As the inside stop flange 312 of the cap member 31 of each fastener 3 is movable between the top flange 11 of the associating mounting barrel 1 and the tapered bearing wall 223 of the associating coupling 22 and the expanded locking tip 3231 of the locking member 32 of each fastener 3 is stoppable at the bottom side of the bottom bearing face 105 of the inside partition wall 102 of the associating mounting barrel 1, the fasteners 3 can be moved axially relative to the associating mounting barrels 1 and will not fall out of the associating mounting barrels 1.

When fastening the first panel member 4 to the second panel member 5, bias the handle 2 from the horizontal position to the vertical position right above the mounting barrels 1 and the fasteners 3, and then lift the handle 2 to let the tapered bearing walls 223 of the couplings 22 be respectively stopped at the bottom side of the cap members 31 of the respective fasteners 3. When continuously lifting the handle 2 at this time, the fasteners 3 will be moved upwards relative to the mounting barrels 1 by the respective couplings 22 to the extent where the inside stop flange 312 of the cap member 31 of each fastener 3 is stopped at the bottom side of the top flange 11 of the associating mounting barrel 1. At this time, the user can carry the handle 2 and the first panel member 4 to the second panel member 5 to keep the two first mounting through holes 41 in alignment with respective second mounting through holes 51 of the second panel member 5, and then bias the handle 2 from vertical to horizontal to expose the fasteners 3, and then force the cap member 31 of each fastener 3 downwardly to compress the associating spring member 33 and fasten the expanded locking tip 3231 of the locking member 32 of each fastener 3 to the respective second mounting through hole 51 of the second panel member 5 to lock the first panel member 4 and the second panel member 5 together.

As the mounting barrels 1, the couplings 22 and the fasteners 3 are disposed at the two downwardly curved distal ends of the handle 2 and the handle 2 is biasable relative to the mounting barrels 1, the panel carrying handle does not occupy much surface space of the first panel member 4, enabling the surface of the first panel member 4 to be fully utilized for the installation of, for example, electronic components. Simply by means of affixing the mounting barrels 1 to the respective first mounting through holes 41 of the first panel member 4, the panel carrying handle is positively secured to the first panel member 4 without any further hole-drilling or screw-fastening procedure. After the first panel member 4 is locked to the second panel member 5, the handle 2 can be biased relative to the mounting barrels 1 from vertical to horizontal to reduce the height. Further, the panel carrying handle can be mounted at the border area of the first panel member 4 without occupying much the surface area of the first panel member 4. Thus, the surface area of the first panel member 4 can be fully utilized for the installation of electronic components, or for the stacking of other panel members.

When going to detach the first panel member 4 from the second panel member 5, bias the handle 2 relative to the mounting barrels 1 from vertical to horizontal (or keeping the handle 2 in the horizontal position), and then rotate the fasteners 3 in the reversed direction to disengage the expanded locking tips 3231 of the respective locking members 32 from the respective second mounting through holes 51 of the second panel member 5. After disengagement of the expanded locking tips 3231 of the respective locking members 32 from the respective second mounting through holes 51 of the second panel member 5, the compression springs 33 immediately return to their former shape to push the locking members 32 and the associating cap members 31 upwardly to the extent where the inside stop flange 312 of the cap member 31 of each fastener 3 is stopped at the bottom side of the top flange 11 of the associating mounting barrel 1, or the expanded locking tip 3231 of the locking member 32 of each fastener 3 is stopped at the bottom side of the bottom bearing face 105 of the inside partition wall 102 of the associating mounting barrel 1. At this time, the user can lift the handle 2 to carry the first panel member 4 away from the second panel member 5.

Further, the inner diameter of the through hole 1021 in the center of the inside partition wall 102 of each mounting barrel 1 is smaller than the outer diameter of the expanded locking tip 3231 of each locking member 32. Further, the expanded locking tip 3231 of the locking member 32 of each fastener 3 is externally threaded so that the threaded expanded locking tip 3231 of the locking member 32 can be threaded through the inner thread 1022 in the through hole 1021 of the inside partition wall 102 of the associating mounting barrel 1 into the bottom open chamber 103 and then stopped below the bottom bearing face 105 of the inside partition wall 102 of the associating mounting barrel 1. Further, the diameter of the top open chamber 101 of each mounting barrel 1 is greater than the diameter of the associating bottom open chamber 103, however, the depth of the top open chamber 101 of each mounting barrel 1 is smaller than the depth of the associating bottom open chamber 103.

Further, the cap member 31 can be separately made and then affixed to the head 322 of the associating locking member 32. Alternatively, the cap member 31 can be directly molded on the head 322 of the associating locking member 32. By means of the large dimension of the cap member 31, a user can hold and operate each fastener 3 to rotate the locking member 32 or to move the locking member 32 axially relative to the associating mounting barrel 1. Further, the second mounting through holes 51 of the second panel member 5 can be mounting screw holes. Further, the handle 2 can be an elongated bar having a cylindrical, rectangular, triangular or polygonal cross section. Further, the handle 2 can have grooves on the periphery thereof to reduce material consumption.

In conclusion, the invention provides a panel carrying handle, which has the advantages and features as follows:

1. By means of affixing the mounting barrels 1 to respective first mounting through holes 41 in the first panel member 4 near the border area thereof and coupling the respective couplings 22 to the mounting barrels 1 and then coupling the two brackets 21 at the two downwardly curved distal ends of the handle 2 to the two couplings 22, the handle 2 is pivotally connected to the first panel member 4, and the fasteners 3 are respectively floatably held in the couplings 2 and the mounting barrels 1 for fastening to the second panel member 5 to detachably lock the first panel member 4 to the second panel member 5 without any further hole-drilling or screw-fastening procedure.
2. By means of coupling the coupling holes 224 of the couplings 22 to the respective mounting barrels 1 and the pivot holes 212 of the brackets 21 of the handle 2 to the pivot rods 221 of the respective couplings 22 after fixation of the mounting barrels 1 to the first panel member 4, the handle 2 is pivotally connected to the first panel member 4 and can be rested on the first panel member 4 in horizontal, enabling the surface area of the first panel member 4 to be fully utilized for the installation of electronic components or stacking of other panel members.

3. When lifting the handle 2, the tapered bearing wall 223 of each coupling 22 will be stopped at the bottom side of the cap member 31 of the associating fastener 3, and the fastener 3 will be moved upwardly with the associating coupling 22 relative to the associating mounting barrel 1 to let the inside stop flange 312 of the cap member 31 of each fastener 3 be stopped at the bottom side of the top flange 11 of the associating mounting barrel 1 or the expanded locking tip 3231 of the locking member 32 of each fastener 3 be stopped at the bottom side of the bottom bearing face 105 of the inside partition wall 102 of the associating mounting barrel 1, and the user can then lift the handle 2 to carry the first panel member 4 to or away from the second panel member 5.

4. The fasteners 3 are floatably supported in the respective mounting barrels 1 in such a manner that the inside stop flange 312 of the cap member 31 of each fastener 3 is stoppable below the top flange 11 of the associating mounting barrel 1 and the expanded locking tip 3231 of the locking member 32 of each fastener 3 is stoppable below the bottom bearing face 105 of the inside partition wall 102 of the associating mounting barrel 1, the fasteners 3 will not fall out of the associating mounting barrels 1 at the first panel member 4 after disengagement of the expanded locking tips 3231 of the locking members 32 from the second panel member 5.

As stated above, the invention provides a panel carrying handle, which comprises two mounting barrels respectively affixed to respective first mounting through holes in a border area of a first panel member, two couplings respectively coupled to the mounting barrels, a handle having two brackets located on two distal ends thereof and respectively pivotally connected to the couplings, and two fasteners floatably supported in the couplings and the mounting barrels and fastenable to respective second mounting through holes in a second panel member to detachably lock the first panel member to the second panel member.

As the panel carrying handle is mounted at the border area of the first panel member without occupying much the surface area of the first panel member and can be biased relative to the first panel member between a vertical position and a horizontal position, the surface area of the first panel member can be fully utilized for the installation of electronic components, or for the stacking of other panel members.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A panel carrying handle mountable at a first panel member and adapted for detachably locking said first panel member to a second panel member, the panel carrying handle comprising:

two mounting barrels respectively affixed to respective first mounting through holes in said first panel member, each said mounting barrel comprising a top flange extending around the periphery near a top end thereof and a bottom flange extending around the periphery and spaced above a bottom end thereof and stopped at a top wall of said first panel member;

two couplings respectively coupled to said mounting barrels, each said coupling comprising an accommodation chamber defined therein, a tapered bearing wall disposed in said accommodation chamber and a coupling hole cut through said tapered bearing wall and coupled to one said mounting barrel;

a handle comprising two brackets respectively located on two downwardly curved distal ends thereof and respectively pivotally connected to said couplings; and two fasteners respectively floatably mounted in said couplings and said mounting barrel and fastenable to one respective second mounting through hole in said second panel member to lock said first panel member to said second panel member, each said fastener comprising a cap member inserted into the accommodation chamber of the associating coupling and coupled to the associating mounting barrel, a locking member affixed to said cap member and a spring member supported between a part of said locking member and a part of one said coupling, said cap member having an outer diameter greater than the coupling hole of said couplings, said locking member comprising a head affixed to said cap member, a mounting flange extending around the periphery of said head, and a shank perpendicularly downwardly extended from a bottom wall of said head at the center and terminating in an expanded locking tip, said expanded locking tip being inserted to the associating mounting barrel for fastening to one respective second mounting through hole of said second panel member, said spring member being sleeved onto the shank of said locking member and stopped between the bottom wall of said head of said locking member and the top bearing face of a part inside the associating mounting barrel.

2. The panel carrying handle as claimed in claim 1, wherein each said mounting barrel comprises an inside partition wall dividing an inside space thereof into opposing top open chamber and bottom open chamber, and a through hole located in the center of said inside partition wall in communication between said top open chamber and said bottom open chamber, said inside partition wall defining opposing top bearing face and bottom bearing face; the shank of the locking member of each said fastener is inserted through the through hole located in the center of the inside partition wall of the associating mounting barrel, and the expanded locking tip of the locking member of each said fastener is stoppable below the bottom bearing face of the inside partition wall of the associating mounting barrel.

3. The panel carrying handle as claimed in claim 2, wherein each said mounting barrel comprises an inner thread located in the through hole of the inside partition wall thereof, and the diameter of the through hole of the inside partition wall of each said mounting barrel is smaller than the diameter of the expanded locking tip of the locking member of the associating fastener.

4. The panel carrying handle as claimed in claim 1, wherein each said coupling comprises two pivot rods respectively extended from the periphery thereof at two opposite sides; each bracket of said handle comprises two parallel arms and two pivot holes respectively located on said parallel arms and respectively pivotally coupled to the pivot rods of said couplings.

5. The panel carrying handle as claimed in claim 1, wherein the cap member of each said fastener comprises a locating groove located on the inside wall thereof and forced into engagement with the mounting flange of the associating locking member.

6. The panel carrying handle as claimed in claim 1, wherein the cap member of each said fastener comprises a center hole cut through a top wall thereof and affixed to the head of the associating locking member and stopped at a top side of the mounting flange of the associating locking member.

7. The panel carrying handle as claimed in claim 1, wherein the locking member of each said fastener further comprises a shoulder extending around the periphery of the shank thereof and abutted against the bottom wall of the head thereof; said spring member is secured to the shoulder of the associating locking member and stopped between the bottom wall of said head of said locking member and the top bearing face of a part inside the associating mounting barrel.

* * * * *